United States Patent [19]

Haes et al.

[11] 4,279,253

[45] Jul. 21, 1981

[54] EPILATION APPARATUS

[75] Inventors: Freddy Haes; Guillaume M. P. G. Hermes; Cornelis M. Reijnhout, all of Eindhoven, Netherlands

[73] Assignee: U.S. Philips Corporation, New York, N.Y.

[21] Appl. No.: 31,572

[22] Filed: Apr. 19, 1979

[30] Foreign Application Priority Data

May 16, 1978 [NL] Netherlands ..... 7805230

[51] Int. Cl.[3] ..... A61B 17/00

[52] U.S. Cl. ..... 128/355; 132/9; 30/32

[58] Field of Search ..... 128/355; 30/32, 43.6; 132/1 R, 9

[56] References Cited

U.S. PATENT DOCUMENTS

| | | | |
|---|---|---|---|
| 2,083,380 | 6/1937 | Hudson | 128/355 |
| 2,112,230 | 3/1938 | Fisher | 128/355 X |
| 2,423,245 | 7/1947 | Magnus | 128/355 |

FOREIGN PATENT DOCUMENTS

| | | | |
|---|---|---|---|
| 340377 | 1/1931 | United Kingdom | 128/355 |

*Primary Examiner*—Jimmy C. Peters

*Attorney, Agent, or Firm*—Thomas A. Briody; William J. Streeter; Rolf E. Schneider

[57] ABSTRACT

There is provided an epilation apparatus comprising a drivable member having a hair-gripping wall, and a stationary complementary member having a confronting wall spaced from the hair-gripping wall of the drivable member to provide a hair gap therebetween.

5 Claims, 4 Drawing Figures

EPILATION APPARATUS

This invention relates to an epilation apparatus having a drivable gripping member.

Such an epilation apparatus is for example known from French Pat. No. 2307491. This known apparatus comprises a plurality of gripping members constituted by rotatable rollers. However, depending on the diameter of the rollers, only hairs of at least a minimum length are gripped and pulled out by the apparatus.

It is the present object of the invention to improve the efficiency of such an apparatus and this leads to a construction which is characterized in that the apparatus has a hair gap between a wall of the gripping member and the confronting wall of a complementary member, the wall of the gripping member being drivable with a relative movement with respect to the confronting wall of the complementary member.

A special embodiment is characterized in that the complementary member is knife-shaped.

A preferred embodiment is characterized in that the gripping member takes the form of a rotatable drum, which is provided with a fine toothing at its circumference.

A special embodiment is characterized in that the hair gap widens in the direction of the relative movement.

A further special embodiment is characterized in that the complementary member includes an elastic tongue.

The invention will now be described in connection with the accompanying drawings, in which:

FIG. 1 schematically shows an epilation apparatus in side view and partly in cross-section.

Figure 1:
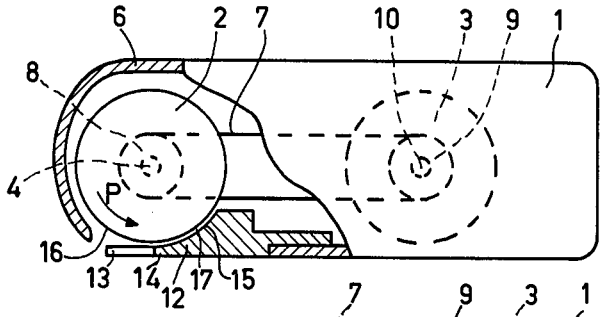
Figure 2:
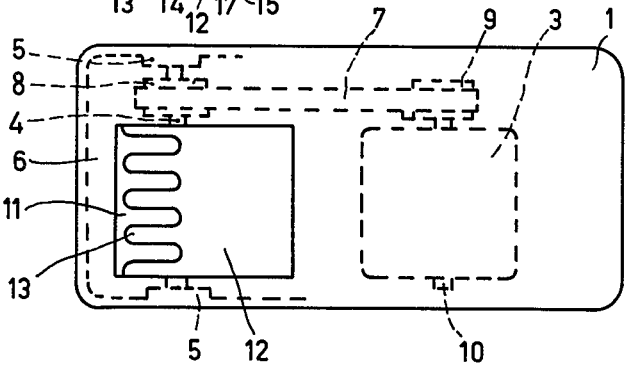
FIG. 2 shows a bottom view of the apparatus of FIG. 1.

The epilation apparatus in accordance with FIGS. 1 and 2 comprises a housing 1 which accommodates a drum 2 and an electric motor 3. The drum constitutes the drivable gripping member and is rotatably journalled in the cams 5 of the housing wall by means of the spindle 4. The drum is driven by the electric motor 3 via the belt 7 which is passed over the pulleys 8 and 9 on the spindle 4 and on the motor shaft 10 respectively.

In the housing wall 6 an opening 11 is formed in which the knife-shaped complementary member 12 is located. The complementary member is provided with fingers 13, a contact surfaces 14 for sliding movement over the skin, and a wall portion 15 having a curved shape which over some distance follows the wall 16 of the drum 2. Between the gripping member and the complementary member the hair gap 17 is located.

Figure 3:
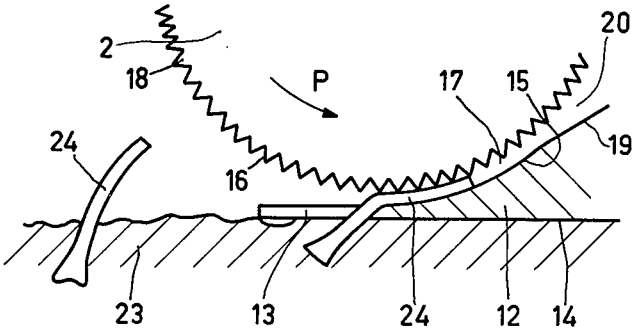
FIGS. 3 and 4 show some variants partly in cross section of the apparatus in accordance with FIGS. 1 and 2 on an enlarged scale and in detail.

In the embodiment of FIG. 3 the drum 2 is provided with teeth 18. In practice it has been found that teeth of triangular cross-section with an apex angle of 60° and a height of approximately 40/$\mu$ yield satisfactory results. As the wall portion 19 of the complementary member 12 curves away from the drum 2, a clearance 20 is formed which is wider than the hair gap between the walls 15 and 16. As a result of this widening of the hair gap 17 in the direction P of the relative movement of the wall 16 with respect to the wall 15 and 19 the risk is reduced of extracted hairs clogging up the hair gap 17.

Figure 4:
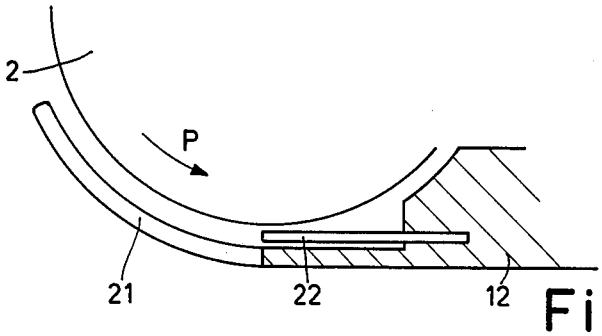

In the embodiment of FIG. 4 the fingers 21 of the complementary member 12 have a curved shape and the complementary member is provided with an elastic tongue 22.

The operation of the three embodiments is basically identical and can best be explained with the aid of FIG. 3, which also shows a skin portion 23 with two hairs 24. During use of the apparatus the contact surface 14 is positioned against the skin. A hair 24 which is caught between the fingers 13 is pushed into the hair gap 17 upon contact with the rotary drum 2.

The hair 24 is clamped between the drum 2 and the complementary member 12, so that great frictional forces are produced between the drum wall 16 and the hair. The hair 24 is consequently moved along by the drum wall, slides along the wall 15 of the complementary member 12, and is pulled out of the skin 23.

The thickness of the complementary member 12 at the location where it changes into the fingers 13 and 21 may be very small, so that every short hairs can be pulled out by means of the apparatus.

The hairs are pulled out of the skin in a direction which is substantially parallel to the skin surface, so that the extraction of the hair roots is effected more gradually. For this direction of extraction the skin moreover presents more resistance to deformation. As a result of this, epilation is less painful in this direction of extraction than in the case of a direction of extraction perpendicular to the skin.

Consequently, it is of importance that the confronting wall portions of the gripping member and the complementary member extend substantially parallel to the contact surface 14, at least at the beginning of the hair gap 17, viewed in the direction of rotation P.

In the embodiment of FIG. 4 the hairs are retained between the drum 2 and the resilient tongue 22, so that differences in retaining force for hairs of different diameters are reduced.

In one of the embodiments it is alternatively possible to journal the drum resiliently, so that the width of the gap 17 can be adapted to the hair thickness.

By means of the toothing on the drum as shown in FIG. 3, a suitable friction is obtained between the drum and a hair. Moreover, the drum may be provided with a separate coating of a material having a high coefficient of friction, such as for example rubber.

In the embodiments shown the complementary member 12 is rigidly connected to the housing and the drum 2 performs a rotary movement relative to the complementary member. In this case only the drum need be driven, which means a simplified construction. However, it is alternatively possible that the complementary member is driven with a reciprocating movement.

Apart from supporting a hair, so that sufficiently large frictional forces are produced between the gripping member and a hair, the complementary member 12 also serves for keeping away the skin. Moreover, the complementary member 12 straightens hairs lying against the skin, so that they are more likely to be gripped by the gripping member and the complementary member. The gripping member may also take the form of a driven continuous belt, preferably also provided with toothing, instead of a drum.

Alternatively, the complementary member 12 may be constructed without the fingers 13, 21.

What we claim is:

1. An epilation apparatus comprising a single rotatable member having a hair-gripping wall; and a stationary complementary member having a wall confronting and spaced from the hair-gripping wall of the rotatable member to provide a hair gap therebetween, the rotation of the rotatable member relative to the complementary member being in a direction into the leading opening of the hair gap; said complementary member having a surface for sliding contact with the skin, the leading edge of said complementary member surface being knife-shaped and having a plurality of parallel fingers extending forwardly therefrom for catching hair therebetween and directing the same into said hair gap.

2. An epilation apparatus according to claim 1, in which the rotatable member comprises a drum provided with circumferential teeth.

3. An epilation apparatus according to claim 1 or 2, in which the hair-gripping wall and the confronting wall are substantially parallel to the contact surface at the leading opening of the hair gap.

4. An epilation apparatus according to claim 1 or 2, in which the hair gap widens in the direction of rotation of the rotatable member.

5. An epilation apparatus according to claim 1 or 2, in which the complementary member includes a forwardly directed elastic tongue.

* * * * *